US005145593A

United States Patent [19]

Takashima

[11] Patent Number: 5,145,593

[45] Date of Patent: * Sep. 8, 1992

[54] LUBRICATING OIL COMPOSITIONS CONTAINING A GLYCERIDE FROM A SATURATED FATTY ACID AND A FATTY ACID

[75] Inventor: Hiroyuki Takashima, Yamato, Japan

[73] Assignee: Nippon Oil Co., Ltd., Tokyo, Japan

[ * ] Notice: The portion of the term of this patent subsequent to Jul. 23, 2008 has been disclaimed.

[21] Appl. No.: 717,269

[22] Filed: Jun. 18, 1991

[30] Foreign Application Priority Data

Jun. 29, 1990 [JP] Japan ..... 2-169867

[51] Int. Cl.[5] ..... C10M 105/36

[52] U.S. Cl. ..... 252/56 S; 252/56 R

[58] Field of Search ..... 252/56 R, 56 S

[56] References Cited

U.S. PATENT DOCUMENTS

| | | | |
|---|---|---|---|
| 3,640,860 | 2/1972 | Miller | 252/56 R |
| 4,637,887 | 1/1987 | Worschech et al. | 252/56 S |
| 4,783,274 | 11/1988 | Gakinen et al. | 252/56 R |
| 5,034,144 | 7/1991 | Ohgake et al. | 252/56 R |

FOREIGN PATENT DOCUMENTS 0382512 8/1990 European Pat. Off. .

OTHER PUBLICATIONS

Chemical Abstracts, vol. 79, No. 9, Nov. 5, 1973, Columbus, Ohio, U.S. Abstract No. 106604W, G. Spengler et al., p. 84, column 1.

World Patents Index Latest, Sectoin Ch, Week 8250, Nov. 4, 1982, Derwent Publications Ltd., London, GB Class J, p. 50, AN 7869 & JP-A-57 179 297.

K. G. Slenn, "*Fatty Oils In Lubrication*", Scientific Lubrication, Dec. 1951, pp. 26–28.

*Primary Examiner*—Jacqueline Howard

*Attorney, Agent, or Firm*—Bucknam and Archer

[57] ABSTRACT

A lubricating oil composition other than that for food processing machines, which comprises (I) as the base oil, a saturated fatty acid glyceride represented by the general formula $$\begin{array}{l} CH_2{-}OCOR_1 \\ | \\ CH{-}OCOR_2 \\ | \\ CH_2{-}OCOR_3 \end{array}$$

wherein $R_1$, $R_2$ and $R_3$ may be identical with, or different from, each other, and are each a straight-chain alkyl group having 5 to 21 carbon atoms, and (II) as an essential component, a fatty acid having 12 to 22 carbon atoms in an amount of 0.001 to 5.0% by weight, based on the total composition.

8 Claims, No Drawings

LUBRICATING OIL COMPOSITIONS CONTAINING A GLYCERIDE FROM A SATURATED FATTY ACID AND A FATTY ACID

BACKGROUND OF THE INVENTION

1. Field of the Invention

This invention relates to a lubricating oil composition and, more specifically, it relates to a lubricating oil composition for use in apparatuses such as compressors and other than food processing machines.

2. Prior Art

Compressed air used in the specific fields, such as the food and its associated industry, medical instruments, pharmaceutical industry and medical care, which are considered to have effects on human bodies, has generally been produced by the combined use of an oil-cooled compressor and a mist filter. Oil-free type compressors have now a power of 15 kW even if they are very small and the apparatus cost is at least about two times as high as the oil-cooled compressor, and therefore, there are few cases in which small- and medium-scale manufactories or medical institutions use such oil-free type compressors.

The circumstances under which compressed air is contacted with human bodies and considered to have effects thereon, include agitation of ice cream and like foodstuffs with compressed air; peeling of onion and like vegetables (instantaneous blowing-off of vegetable skins with compressed air); stirring of soybean and like foods which are in the process of fermentation, with compressed air; blowing-off of the portion of a refreshing drink or an alcoholic beverage spilt around the mouth of the bottles at the time of filling the bottles with said liquid; cleaning of bottles with compressed air; transportation of sugar and like powders with compressed air; the use of compressed air as an air source for dentists' hand air-drill; and cleaning of oral cavities with compressed air. In a case where compressed air produced by the combined use of an oil-cooled compressor and a mist filter is to be used under various circumstances, it will be very difficult to completely remove the oil mist from the compressed air over a long period of time, and there are possibilities that several p.p.m. to several tens of p.p.m. of the oil will be discharged to the outside of the system.

Further, a screw type compressor has generally been used to compress $CO_2$ gas so as to produce dry ice therefrom in small- and medium-scale factories. A lubricating oil used in the compressor in this case is lubricating the compressor while the oil is in direct contact with it, and, therefore, the lubricating oil should be one whose safety for human bodies has been taken into consideration from the standpoint of the use of dry ice. Additionally, the lubricating oil is required to have oxidation resistance since it is incorporated with a minute amount of air. For this reason, lubricating oils for a compressor which have heretofore been used for the above purpose, include animal and vegetable oils having high safety and liquid paraffin. However, these conventional oils and liquid paraffin raise problems as to insufficient rust preventiveness and oxidation stability.

Accordingly, no oils having high safety for such apparatuses as compressors and also having excellent oxidation stability, rust preventiveness and lubricity, have been developed and therefore, the conventional lubricating oils have had various problems to be solved before the accomplishment of the present invention.

SUMMARY OF THE INVENTION

The present inventor made intensive studies in an attempt to develop lubricating oils which are safe for human bodies and excellent in lubricity, rust preventiveness and oxidation stability in view of the above problems and, as the result of his studies, he found that lubricating oils comprising a glyceride having a specific chemical structure as the base oil and further comprising a specific compound satisfy the above conditions or properties. This invention is based on this finding.

The object of this invention is to provide lubricating oil compositions which are safe for human bodies and are excellent in lubricity, rust preventiveness and oxidation stability.

The lubricating oil compositions (other than lubricating oil compositions for food processing machines) of the present invention are characterized in that they comprise (I) as the base oil, a saturated fatty acid glyceride represented by the general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ may be identical with, or different from, each other, and are each a straight-chain alkyl group having 5 to 21 carbon atoms, and (II) as an essential component, a fatty acid having 12 to 22 carbon atoms in an amount of 0.001 to 5.0% by weight, based on the total composition.

This invention will be explained below in more detail.

A saturated fatty acid glyceride (I) used in the present invention is represented by the following general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ may be identical with, or different from, each other, and are each straight-chain alkyl group having 5 to 21, preferably 5 to 11, carbon atoms. If there is used such a glyceride which contains straight-chain alkyl groups having carbon atoms the number of which is outside said range defined in the invention, contains branched-chain alkyl groups or contains unsaturated groups, the resulting oil composition will be unfavorable in viscosity, pour point, oxidation stability and the like.

The $R_1$, $R_2$ and $R_3$ in the general formula representing the straight-chain alkyl group in said saturated fatty acid glyceride (I) used in the present invention each include pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl and heneicosyl groups.

Although a method for producing the saturated fatty acid glyceride (I) is not specified, a typical one comprises the steps of hydrolyzing natural oils or fats to separate glycerin from the corresponding fatty acids, extracting only saturated fatty acids therefrom and reacting said extracted saturated fatty acids with glycerin to obtain the glyceride (I).

The saturated fatty acid glyceride (I) used in the present invention is quite harmless for human bodies as is apparent from the fact that the glyceride has been designated as a food additive.

The component (II) used in the present invention is a fatty acid having 12 to 22 carbon atoms, preferably a saturated fatty acid having 12 to 20 carbon atoms. If there is used, instead of the component (II), a fatty acid having carbon atoms the number of which is outside said range defined in the invention, the resulting oil composition will disadvantageously be inferior in oxidation stability, lubricity and the like.

The fatty acids (II) having 12 to 22 carbon atoms used in the present invention, may be naturally occuring ones or synthetic ones and may be straight-chain ones or branched-chain ones. The fatty acids (II) are exemplified by lauric acid, tridecyl acid, myristic acid, pentadecyl acid, palmitic acid, heptadecyl acid, stearic acid, nonadecanoic acid, arachic acid, behenic acid, oleic acid, elaidic acid, cetoleic acid, erucic acid, brassidic acid, linoleic acid, linolenic acid, arachidonic acid, stearolic acid and mixtures thereof. Among these fatty acids, the preferable ones are saturated fatty acids having 14, 16, 18 or 20 carbon atoms and mixtures of at least two kinds of the saturated fatty acids.

These fatty acids are quite harmless for human bodies as is apparent from the fact that they have been designated as flavor additives for food and have been also nominated for standard items of raw materials for cosmetics.

The amount of the saturated fatty acid having 12 to 22 carbon atoms incorporated in the lubricating oil composition of the present invention is in the range of 0.001 to 5.0% by weight, preferably 0.01 to 1.0% weight, based on the total amount of the composition. In a case where the content of the fatty acid is less than the above range defined in the present invention, the resulting composition will not be satisfactory in oxidation stability, rust preventiveness and lubricity, while in a case where the content of the fatty acid is more than said range, no further advantage is obtained.

According to the present invention, a saturated fatty acid glyceride (I) as the base oil, is incorporated with a specified amount of a fatty acid having 12–22 carbon atoms (II) as the essential component, so as to obtain a lubricating oil composition which is excellent in various performances. Furthermore, dibutylhydroxytoluenes and/or tocopherols (vitamin E) may be added to the composition in order to enhance the composition in performances as a lubricating oil. The dibutylhydroxytoluenes and/or tocopherols are exemplified by 2,6-ditertiarybutyl-4-hydroxytoluene, α-tocopherol, β-tocopherol, γ-tocopherol, δ-tocopherol and mixtures thereof.

These compounds have been designated as antioxidant additives for food and are quite harmless for human bodies.

In a case where the dibutylhydroxytoluenes and/or tocopherols are to be added to the glyceride (I) and the fatty acid (II) according to the present invention, these additives are incorporated in the resulting lubricating oil composition in an amount of 0.01 to 5.0% by weight, preferably 0.01 to 1.0% by weight, of the total amount of the composition.

To further enhance the lubricating oil composition in performances, it may be incorporated with other additives as required. However, such additives selected should be harmless to human bodies and, for this reason, they may include higher aliphatic alcohols such as oleyl alcohol; animal and vegetable oils or those partially hydrogenated; higher aliphatic acid esters such as methyl laurate and butyl stearate; oxidation preventives such as tertiarybutyl hydroxyanisole; sorbitane aliphatic acid esters which are a rust preventive, such as sorbitane monooleate; and sucrose aliphatic acid esters such as sucrose monolaurate.

These additives may be used singly or jointly. Although the amount of the additive used is not specified, the preferable amount of one additive used is 20.0% or less by weight, more preferably 0.1% to 10.0% by weight, based on the total composition.

The lubricating oil compositions of the present invention not only may preferably be used particularly as those for compressors, but also may preferably be used as metal processing oils for cutting, griding, rolling and the like, and as lubricating oils for sliding guide surfaces, hydraulic-actuated equipment, chains, bearings, chain saws and the like where the lubricating oils are liable to contact with human bodies.

The present invention will be better understood by the following Examples and Comparative Examples, but the present invention is not limited to the embodiments described in the Examples.

EXAMPLES 1–5 AND COMPARATIVE EXAMPLES 1–2

There were obtained lubricating oil compositions respectively having the constitutions shown in Table 1 (Examples 1–5). The compositions so obtained were measured for their performances (wear resistance, rust preventiveness, oxidation stability and service life estimated by the use of actual equipment) by the following methods, and the results are shown in Table 1. For comparison, a comparative oil consisting only of glyceride (I) (Comparative Example 1) and another comparative oil consisting only of liquid paraffin (Comparative Example 2) were evaluated for their performances in the same manner as in Examples 1–5, and the results are also shown in Table 1.

Wear Resistance

Using each of the test oils, the sear diameters (mm) produced by wear was measured in terms of wear resistance according to "Wear preventive characteristics of lubricating fluid (FOUR-BALL METHOD)" prescribed in ASTM D 4172 under the conditions of 1,200 rpm, 15 kg and 30 min.

Rust Preventiveness

The rust preventiveness of each of the test oils was measured according to "The method of testing the rust preventiveness of lubricating oils (The method using distilled water)" prescribed in JIS K 2510.

Oxidation Stability

The endurance of stability against oxidation (min.) of each of the test oils was measured at 120° C. according to "The rotary bomb type oxidation stability test method" prescribed in JIS K 2514 3.3.

Service Life Estimated by Use of Actual Equipment

The service life of each of the test oils was evaluated by continuously running a screw compressor produced by KOBE STEEL, LTD. (motor output: 6 kW) while using the test oil as the lubricating oil under the conditions of a tank pressure of 7 kg f/cm$^2$ and an average tank oil temperature of 80° C.

TABLE 1

| | | Example, Comparative Example | | | | | | |
|---|---|---|---|---|---|---|---|---|
| | | Example 1 | Example 2 | Example 3 | Example 4 | Example 5 | Comp. Ex. 1 | Comp. Ex. 2 |
| Composition (wt. %) | $C_{16}$ fatty acid | 0.1 | — | — | — | — | — | — |
| | $C_{18}$ fatty acid | — | 0.1 | — | 0.1 | 0.1 | — | — |
| | $C_{20}$ fatty acid | — | — | 0.1 | — | — | — | — |
| | Dibutylhydroxytoluene | — | — | — | 0.01 | — | — | — |
| | Tocopherols | — | — | — | — | 0.01 | — | — |
| | Glyceride *1 | residue | residue | residue | residue | residue | 100 | — |
| | Liquid paraffin *2 | — | — | — | — | — | — | 100 |
| Diameter (mm) of dint produced by wear | | 0.45 | 0.41 | 0.42 | 0.41 | 0.41 | 0.52 | 0.56 |
| Rust preventiveness (1 hr. later) | | no rust | no rust | no rust | no rust | no rust | rusted all over the surface | rusted all over the surface |
| Rust preventiveness (12 hrs. later) | | slightly rusted | slightly rusted | slightly rusted | slightly rusted | slightly rusted | rusted all over the surface | rusted all over the surface |
| Endurance of stability against oxidation (min.) at 120° C. | | 600 | 600 | 600 | 1100 | 900 | 600 | 340 |
| Service life estimated by use of actual equipment (hr.) | | 200 | 200 | 200 | 400 | 350 | 160 | 80 |

*1: $C_8$–$C_{10}$ saturated fatty acid triglyceride
*2: 23 cSt, at 40° C.

Effect of the Invention

As is apparent from the above results described in Table 1, the lubricating oil compositions of the present invention are excellent in lubricity, rust preventiveness and oxidation stability as compared with conventional lubricating oils and, in addition, are quite safe for human bodies.

What is claimed is:

1. A lubricating oil composition other than that for food processing machines, which consists of (I) as the base oil, a saturated fatty acid glyceride represented by the general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ may be identical with, or different from, each other, and are each a straight-chain alkyl group having 5 to 21 carbon atoms, and (II) as an essential component, a fatty acid having 12 to 22 carbon atoms in an amount of 0.001 to 5.0% by weight, based on the total composition.

2. A lubricating oil composition for compressors which consists of (I) as the base oil, a saturated fatty acid glyceride represented by the general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ may be identical with, or different from, each other, and are each a straight-chain alkyl group having 5 to 21 carbon atoms, and (II) as an essential component, a fatty acid having 12 to 22 carbon atoms in an amount of 0.001 to 5.0% by weight, based on the total composition.

3. A lubricating oil composition according to claim 1, wherein said fatty acid is one member selected from the group consisting of saturated fatty acids having 14, 16, 18 or 20 carbon atoms and mixtures thereof.

4. A lubricating oil composition according to claim 2, wherein said fatty acid is one member selected from the group consisting of saturated fatty acids having 14, 16, 18 or 20 carbon atoms and mixtures thereof.

5. A lubricating oil composition other than that for food processing machines, which consists of (I) as the base oil, a saturated fatty acid glyceride of formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ are the same or different, and are each a straight-chain alkyl group having 5 to 21 carbon atoms, (II) as an essential component, a fatty acid having 12 to 22 carbon atoms in an amount of 0.001 to 5.0% by weight, based on the total composition, and (III) at least one member selected from the group consisting of dibutylhydroxytoluenes and tocopherols in an amount of 0.01 to 5.0% by weight, based on the total composition.

6. A lubricating oil composition according to claim 5, wherein said fatty acid is one member selected from the group consisting of saturated fatty acids having 14, 16, 18 or 20 carbon atoms and mixtures thereof.

7. A lubricating oil composition for compressors which consists of (I) as the base oil, a saturated fatty acid glyceride of formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ are the same or different, and are each a straight-chain alkyl group having 5 to 21 carbon atoms, (II) as an essential component, a fatty acid having 12 to 22 carbon atoms in an amount of 0.001 to 5.0% by weight, based on the total composition and (III) at least one member selected from the group consisting of dibutylhydroxytoluenes and tocopherols in an amount of 0.01 to 5.0% by weight, based on the total composition.

8. A lubricating oil composition according to claim 7, wherein said fatty acid is one member selected from the group consisting of saturated fatty acids having 14, 16, 18 or 20 carbon atoms and mixtures thereof.

* * * * *